US011248369B2

(12) United States Patent
Williams et al.

(10) Patent No.: US 11,248,369 B2
(45) **Date of Patent: *Feb. 15, 2022**

(54) DECORATIVE AIR GAP CAP COVER

(71) Applicants: Luke J. Williams, Folsom, CA (US); Luke M. Williams, Orangevale, CA (US)

(72) Inventors: Luke J. Williams, Folsom, CA (US); Luke M. Williams, Orangevale, CA (US)

(73) Assignee: UNITED AIR GAP COVERS INC., Orangevale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/087,001

(22) Filed: Nov. 2, 2020

(65) Prior Publication Data

US 2021/0047814 A1 Feb. 18, 2021

Related U.S. Application Data

(63) Continuation of application No. 16/528,398, filed on Jul. 31, 2019, now Pat. No. 10,822,779.

(51) Int. Cl.
*E03C 1/10* (2006.01)

(52) U.S. Cl.
CPC ..... *E03C 1/102* (2013.01); *Y10T 137/3185* (2015.04)

(58) Field of Classification Search
CPC ..... E03C 1/102; Y10T 137/3185
See application file for complete search history.

(56) References Cited

U.S. PATENT DOCUMENTS 3,183,923 A * 5/1965 Henrikson ..... E03C 1/184 137/216
3,512,545 A ‡ 5/1970 Weaver ..... F16K 24/04 137/216
3,929,149 A ‡ 12/1975 Phillips ..... F16K 15/04 137/216
4,399,832 A ‡ 8/1983 Appleby ..... E03C 1/102 137/21
4,804,010 A * 2/1989 Meissenburg ..... E03C 1/04 137/216

(Continued)

*Primary Examiner* — Kevin R Barss
(74) *Attorney, Agent, or Firm* — Inventive Law Inc.; Jim H. Salter

(57) ABSTRACT

A decorative air gap cap cover is disclosed. An example embodiment can include: a hollow decorative shell configured with upper and lower interior regions relative to an internal ridge, the internal ridge configured to rest on an upper surface of a ring gasket installed around an air gap cap, the air gap cap being captured within the upper and lower interior regions of the hollow decorative shell; a fluid channel within the hollow decorative shell configured with an entry opening above the internal ridge and an exit opening below the internal ridge, the exit opening terminating at an exit port of the hollow decorative shell; and a top vent hole providing an air channel between the upper interior region and the exterior of the hollow decorative shell. An embodiment can also include an auxiliary fluid channel configured with an entry opening below the internal ridge and an exit opening below the internal ridge.

20 Claims, 4 Drawing Sheets

(56) References Cited

U.S. PATENT DOCUMENTS

| | | | | | |
|---|---|---|---|---|---|
| 5,305,778 | A ‡ | 4/1994 | Traylor | E03C 1/102 | 137/21 |
| 5,592,964 | A ‡ | 1/1997 | Traylor | E03C 1/102 | 137/21 |
| 5,713,385 | A ‡ | 2/1998 | Traylor | E03C 1/102 | 137/21 |
| 5,813,702 | A ‡ | 9/1998 | McGuire | E03C 1/102 | 285/148.23 |
| 5,865,209 | A ‡ | 2/1999 | Vidal | E03C 1/102 | 137/21 |
| 6,510,863 | B1 ‡ | 1/2003 | Traylor | E03C 1/12 | 137/21 |
| 6,971,400 | B1 ‡ | 12/2005 | Bowman | E03C 1/12 | 137/21 |
| 7,210,599 | B1 ‡ | 5/2007 | Pfaff | B05B 11/0005 | 222/78 |
| D620,584 | S ‡ | 7/2010 | McAlpine | D23/386 | |
| D642,243 | S ‡ | 7/2011 | Seehoff | D23/260 | |
| D658,272 | S ‡ | 4/2012 | McClure | D23/25 | |
| D661,781 | S ‡ | 6/2012 | McClure | D23/24 | |
| 9,198,543 | B1 ‡ | 12/2015 | Hsieh | A47K 5/1205 | |
| 2016/0115680 | A1 ‡ | 4/2016 | Pargeter | E03C 1/102 | 137/21 |

* cited by examiner
‡ imported from a related application

DECORATIVE AIR GAP CAP COVER

PRIORITY PATENT APPLICATION

This patent application is a continuation patent application drawing priority from U.S. non-provisional patent application Ser. No. 16/528,398; filed Jul. 31, 2019. This present non-provisional patent application draws priority from the referenced patent application. The entire disclosure of the referenced patent application is considered part of the disclosure of the present application and is hereby incorporated by reference herein in its entirety.

TECHNICAL FIELD

The disclosed subject matter relates to the field of air gap caps and, in particular, to a decorative air gap cap cover.

COPYRIGHT

A portion of the disclosure of this patent document contains material that is subject to copyright protection. The copyright owner has no objection to the facsimile reproduction of the patent document or the patent disclosure, as it appears in the U.S. Patent and Trademark Office patent files or records, but otherwise reserves all copyright rights whatsoever. The following notice applies to the disclosure provided herein and to the drawings that form a part of this document: Copyright 2018-2020, Luke J. WILLIAMS and Luke M. WILLIAMS; All Rights Reserved.

BACKGROUND

Air gaps exist to vent the connection of drainage from a dishwasher to the pipeline of a sink. This connection needs the opening of the air gap to prevent wastewater draining from the sink from backing up into the dishwasher by allowing overflow through the hole in the air gap cap. The air gap cap covers the exposed portion of the air gap that is visible above the counter and is located at the rear of the sink alongside the faucet, connected to a pipe carrying the drainage from the dishwasher.

Existing air gap caps are unexpressive and add nothing to the aesthetic of a kitchen. There is a need to be able to modify standard air gap caps to match personal preferences and expand stylistic choices. There is also a functional need to enable coverage of a standard air gap cap while retaining a vent opening and controlling fluid outflow.

SUMMARY

A decorative air gap cap cover is disclosed. In various example embodiments, a decorative air gap cap cover is comprised of a hollow decorative shell of any appealing outer shape and design, which fits over the top of and captures a conventional air gap cap. The decorative air gap cap cover can completely contain and seal the conventional air gap cap. An interior surface of the hollow decorative shell is shaped with an internal ridge on the inner surface which rests on a ring gasket in place around the perimeter of an existing air gap cap below the vent hole of the existing air gap cap. The hollow decorative shell is configured with an open or hollow interior region having an upper interior region above the internal ridge and above the ring gasket and a lower interior region below the internal ridge and below the ring gasket. The upper interior region of the hollow decorative shell is externally vented via a top vent hole at the top of the decorative air gap cap cover. This top vent hole enables the decorative air gap cap cover to retain the venting function of the conventional air gap cap. The hollow decorative shell can also include a fluid channel with an opening in the upper interior region of the hollow decorative shell above the internal ridge. The fluid channel terminates at an exit port at the base of the decorative air gap cap cover. The hollow decorative shell can also include an auxiliary fluid channel with an opening in the lower interior region of the hollow decorative shell below the internal ridge and below the ring gasket. The auxiliary fluid channel also terminates at the exit port at the base of the decorative air gap cap cover. The fluid channel and the auxiliary fluid channel of the decorative air gap cap cover drains off any fluid that may leak or accumulate from the existing air gap cap. The bottom surface of the hollow decorative shell can also include a water-resistant bottom gasket that circumscribes the existing air gap cap to ensure any fluid that may leak from the existing air gap cap into the lower interior region exits the lower interior region through the auxiliary fluid channel, and to prevent the decorative air gap cap cover from scratching the surface of the sink or countertop.

BRIEF DESCRIPTION OF THE DRAWINGS

Embodiments are illustrated by way of example and not limitation in the figures of the accompanying drawings, in which.

DETAILED DESCRIPTION

In the following detailed description, reference is made to the accompanying drawings that form a part hereof, and in which are shown, by way of illustration, specific embodiments in which the disclosed subject matter can be practiced. It is understood that other embodiments may be utilized, and structural changes may be made without departing from the scope of the disclosed subject matter.

Figure 1:
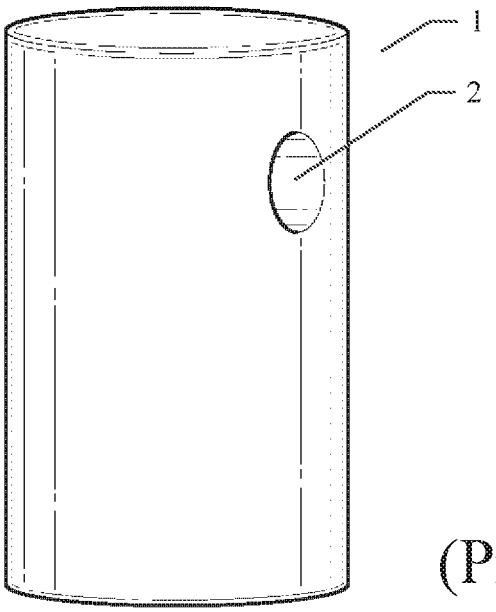
Fig. 1 (Prior Art)
FIG. 1 illustrates a perspective view of a conventional air gap cap.

In various example embodiments disclosed and illustrated herein, a decorative air gap cap cover is shown and described. FIG. 1 illustrates a perspective view of a conventional air gap cap 1. The vent hole 2 allows venting of the connection between piping from appliance drainage and piping for drainage of the sink. The conventional air gap cap 1 keeps the opening of this venting pipe covered and enclosed apart from the vent hole 2. Occasionally, water or other fluid can back up into the conventional air gap cap 1 and leak out of the vent hole 2 or under the bottom of the conventional air gap cap 1.

Figure 2:
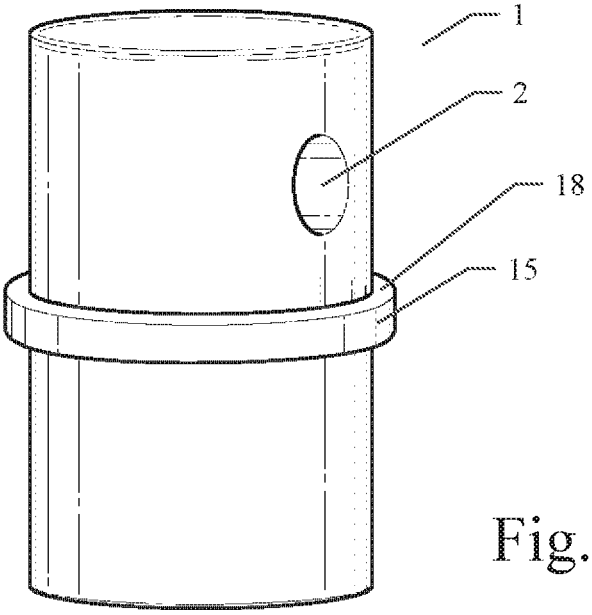
FIG. 2 illustrates a perspective view of a conventional air gap cap with an installed ring gasket of an example embodiment.

FIG. 2 illustrates a perspective view of the conventional air gap cap 1 with an installed ring gasket 15 of an example embodiment. In various example embodiments, the ring gasket 15 can be fabricated from rubber, cork, plastic, or other flexible material. The ring gasket 15 can slightly stretch and grip the conventional air gap cap 1 around its perimeter. The ring gasket 15 includes an upper surface 18 that circumscribes the conventional air gap cap 1 when the ring gasket 15 is installed onto the conventional air gap cap 1. The ring gasket 15 can be installed onto the conventional air gap cap 1 by sliding the ring gasket 15 down from the top of the conventional air gap cap 1. The ring gasket 15 can make a watertight seal around the conventional air gap cap 1. As described in more detail below, the upper surface 18 provided by the ring gasket 15 serves to hold or support the decorative air gap cap cover 100 of an example embodiment in position over the conventional air gap cap 1 while maintaining the venting function of the conventional air gap cap 1 and draining off any fluid that may leak from the conventional air gap cap 1.

Figure 3:
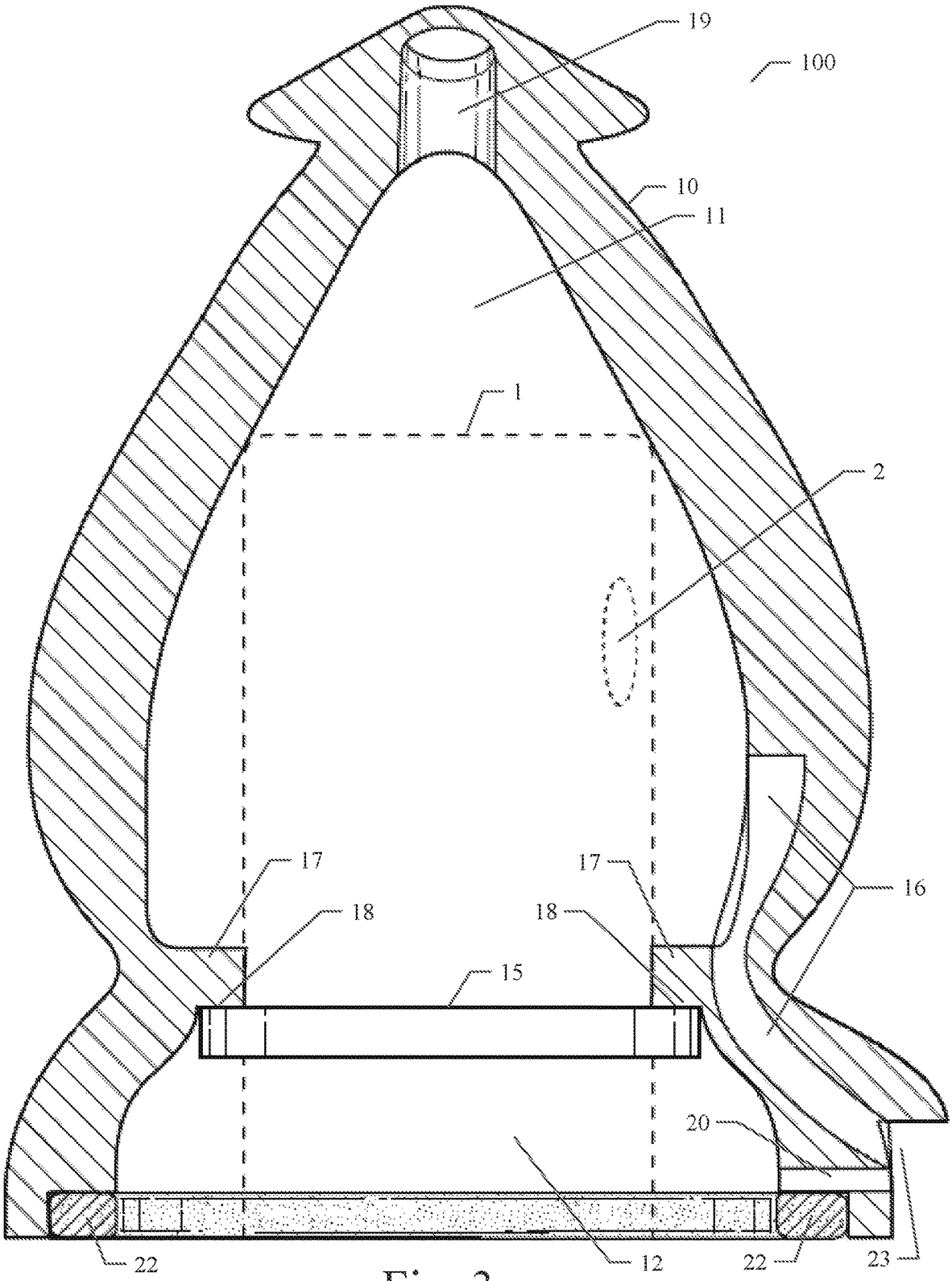
FIG. 3 illustrates a side interior view of the decorative air gap cap cover of an example embodiment.

FIG. 3 illustrates a side interior view of the decorative air gap cap cover 100 of an example embodiment. In an example embodiment, the decorative air gap cap cover 100 is comprised of a hollow decorative shell 10, which can be made of ceramic, plastic, metal, wood, or other rigid material, forming the desired shape of the embodiment. The hollow decorative shell 10 is configured with an open or hollow interior region having an upper interior region 11 above the internal ridge 17 and above the ring gasket 15 and a lower interior region 12 below the internal ridge 17 and below the ring gasket 15. The interior region of the hollow decorative shell 10 is configured to accommodate the conventional air gap cap 1 within the interior region. The hollow decorative shell 10 is also configured with an internal ridge 17 on the interior surface of the hollow decorative shell 10, which rests on the upper surface 18 of the ring gasket 15 installed around the perimeter of the conventional air gap cap 1. The internal ridge 17 and the upper surface 18 of the ring gasket 15 serve to align and center the conventional air gap cap 1 within the interior region of the decorative air gap cap cover 100. This alignment also positions a fluid channel 16 of the decorative air gap cap cover 100 adjacent to and below the vent hole 2 of the conventional air gap cap 1. The fluid channel 16 can be configured at least partially within the upper interior region 11 or as a void within the hollow decorative shell 10. The fluid channel 16 is also configured with an entry opening into the upper interior region 11 and above the internal ridge 17 and with an exit opening below the internal ridge 17 near the bottom of the decorative air gap cap cover 100. The exit opening of the fluid channel 16 terminates at an exit port 23 that opens to the outside of the hollow decorative shell 10. The fluid channel 16 provides a path for fluid runoff to drain outside of the hollow decorative shell 10, if fluid is ejected from the conventional air gap cap 1 through vent hole 2 and backs up within the upper interior region 11.

The decorative air gap cap cover 100 of an example embodiment can also be configured with an auxiliary fluid channel 20 below the internal ridge 17 and below the ring gasket 15. The auxiliary fluid channel 20 can be configured at least partially within the lower interior region 12 or as a void within the hollow decorative shell 10. The auxiliary fluid channel 20 is configured with an entry opening into the lower interior region 12 and below the internal ridge 17 and below the ring gasket 15. The auxiliary fluid channel 20 is also configured with an exit opening below the internal ridge 17 and below the ring gasket 15 near the bottom of the decorative air gap cap cover 100. The exit opening of the auxiliary fluid channel 20 terminates at the exit port 23 that opens to the outside of the hollow decorative shell 10. The auxiliary fluid channel 20 provides a path for fluid runoff to drain outside of the hollow decorative shell 10, if fluid backs up within the lower interior region 12. This situation may occur if the ring gasket 15 is improperly installed, the ring gasket 15 fails to make a watertight seal around the conventional air gap cap 1, or fluid leaks from under the bottom of the conventional air gap cap 1.

Referring still to FIG. 3 for an example embodiment, the top of the hollow decorative shell 10 is configured with a top vent hole 19, which provides an air channel from the upper interior region 11 and the vent hole 2 to the outside or exterior of the hollow decorative shell 10. The top vent hole 19 enables the decorative air gap cap cover 100 to maintain the function of vent hole 2 as a vent for air via the conventional air gap cap 1. It will be apparent to those of ordinary skill in the art in view of the disclosure herein that multiple top vent holes 19 may be used in an alternative embodiment or that the top vent hole 19 may be placed on a side of the hollow decorative shell 10 instead of at the top.

Figure 4:
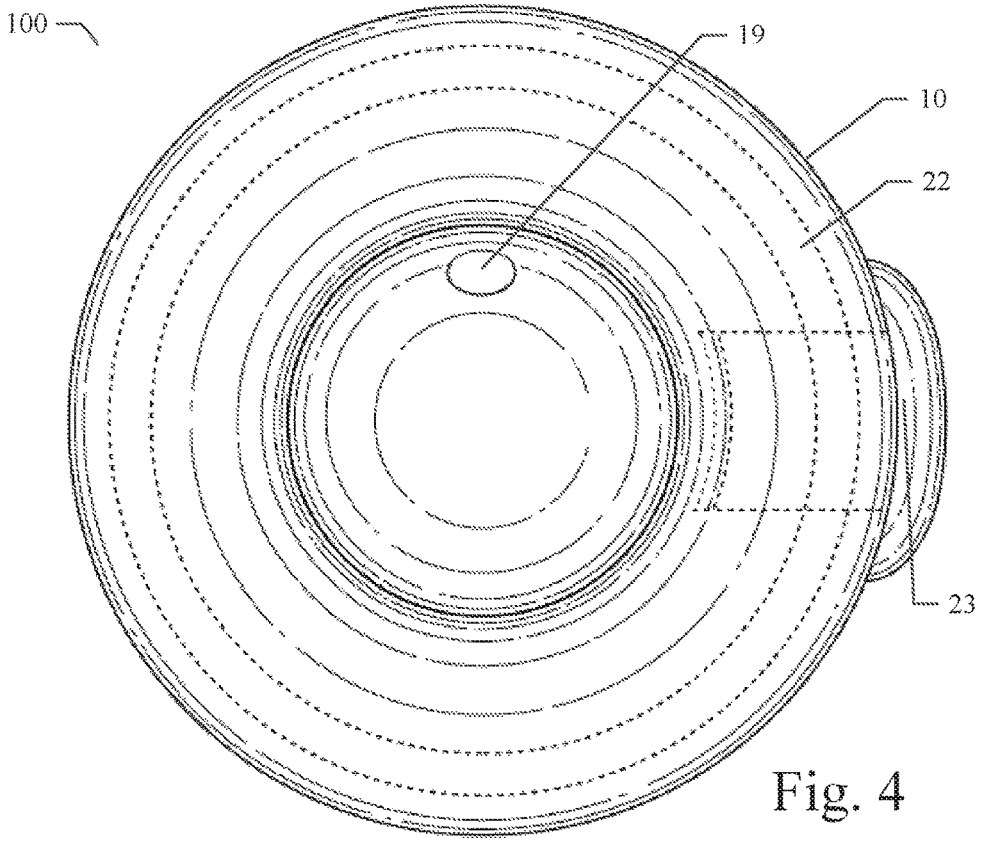
FIG. 4 illustrates a top view of the decorative air gap cap cover of an example embodiment.
Figure 5:
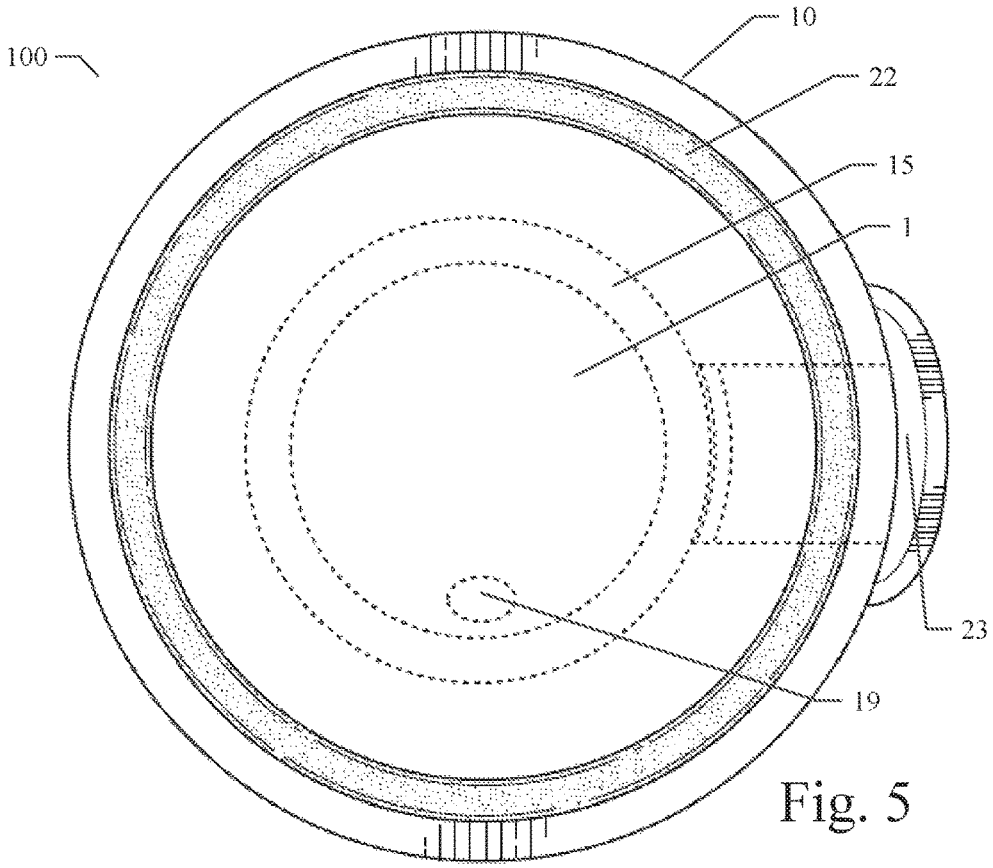
FIG. 5 illustrates a bottom view of the decorative air gap cap cover of an example embodiment.

In the example embodiment illustrated in FIGS. 3 through 5, the bottom surface of the hollow decorative shell 10 can include a bottom gasket 22, which can be fabricated from water-resistant rubber, plastic, cork, or other flexible and fluid-sealing material. As shown in FIGS. 4 and 5, the bottom gasket 22 circumscribes or encircles the conventional air gap cap 1 captured within the decorative air gap cap cover 100. The bottom gasket 22 can also be partially or completely integrated into the bottom surface of the hollow decorative shell 10 as shown in FIG. 3. When the decorative air gap cap cover 100 is placed over the conventional air gap cap 1, the bottom gasket 22 makes contact with the sink or countertop through which, or on which, the conventional air gap cap 1 is installed. This contact seals the bottom gasket 22 to the top surface of the sink or countertop and provides a fluid barrier completely around the conventional air gap cap 1. As a result, any fluid leaking from the conventional air gap cap 1 is retained within the upper interior region 11 or lower interior region 12 of the decorative air gap cap cover 100. As fluid backs up within the upper interior region 11 of the decorative air gap cap cover 100, this fluid can be drained off via the fluid channel 16 and out through exit port 23. As fluid backs up within the lower interior region 12 of the decorative air gap cap cover 100, this fluid can be drained off via the auxiliary fluid channel 20 and out through exit port 23. In this manner, the decorative air gap cap cover 100 provides a watertight seal completely around the conventional air gap cap 1 and forces any excess fluid to drain in a common and predictable location adjacent to the exit port 23. Thus, the bottom gasket 22 seals the conventional air gap cap 1 and prevents any mess or damage to the surface of the sink or countertop.

FIG. 4 illustrates a top view of the decorative air gap cap cover 100 of an example embodiment. As shown, the decorative air gap cap cover 100 can include the hollow decorative shell 10 with top vent hole 19 to maintain the function of vent hole 2 of the conventional air gap cap 1. The decorative air gap cap cover 100 is also shown to include the exit port 23 through which any fluid that has backed up within the upper interior region 11 and/or lower interior region 12 of the decorative air gap cap cover 100 can be drained off via the fluid channel 16 and/or the auxiliary fluid channel 20 and out through exit port 23. The decorative air gap cap cover 100 is also shown to include the bottom gasket 22 shown with dashed lines as the bottom gasket 22 is hidden from a top view of the decorative air gap cap cover 100.

FIG. 5 illustrates a bottom view of the decorative air gap cap cover 100 of an example embodiment. In the illustrated example embodiment, the bottom surface of the hollow decorative shell 10 can include the bottom gasket 22, which circumscribes or encircles the conventional air gap cap 1 captured within the decorative air gap cap cover 100. When the decorative air gap cap cover 100 is placed over the conventional air gap cap 1, the bottom gasket 22 makes contact with the sink or countertop through which or on which the conventional air gap cap 1 is installed. This contact seals the bottom gasket 22 to the top surface of the sink or countertop and provides a fluid barrier completely around the conventional air gap cap 1. As a result, any fluid leaking from the conventional air gap cap 1 is retained within the upper interior region 11 and/or the lower interior region 12 of the decorative air gap cap cover 100. As fluid backs up within the upper interior region 11 and/or the lower interior region 12 of the decorative air gap cap cover 100, this fluid can be drained off via the fluid channel 16 and/or the auxiliary fluid channel 20 and out through exit port 23. In this manner, the decorative air gap cap cover 100 provides a watertight seal completely around the conventional air gap cap 1 and forces any excess fluid to drain in a common and predictable location adjacent to the exit port 23. Thus, the bottom gasket 22 seals the conventional air gap cap 1 and prevents any mess or damage to the surface of the sink or countertop. FIG. 5 also illustrates ring gasket 15 installed around conventional air gap cap 1. FIG. 5 also illustrates top vent hole 19 and exit port 23 as described above.

Figure 6:
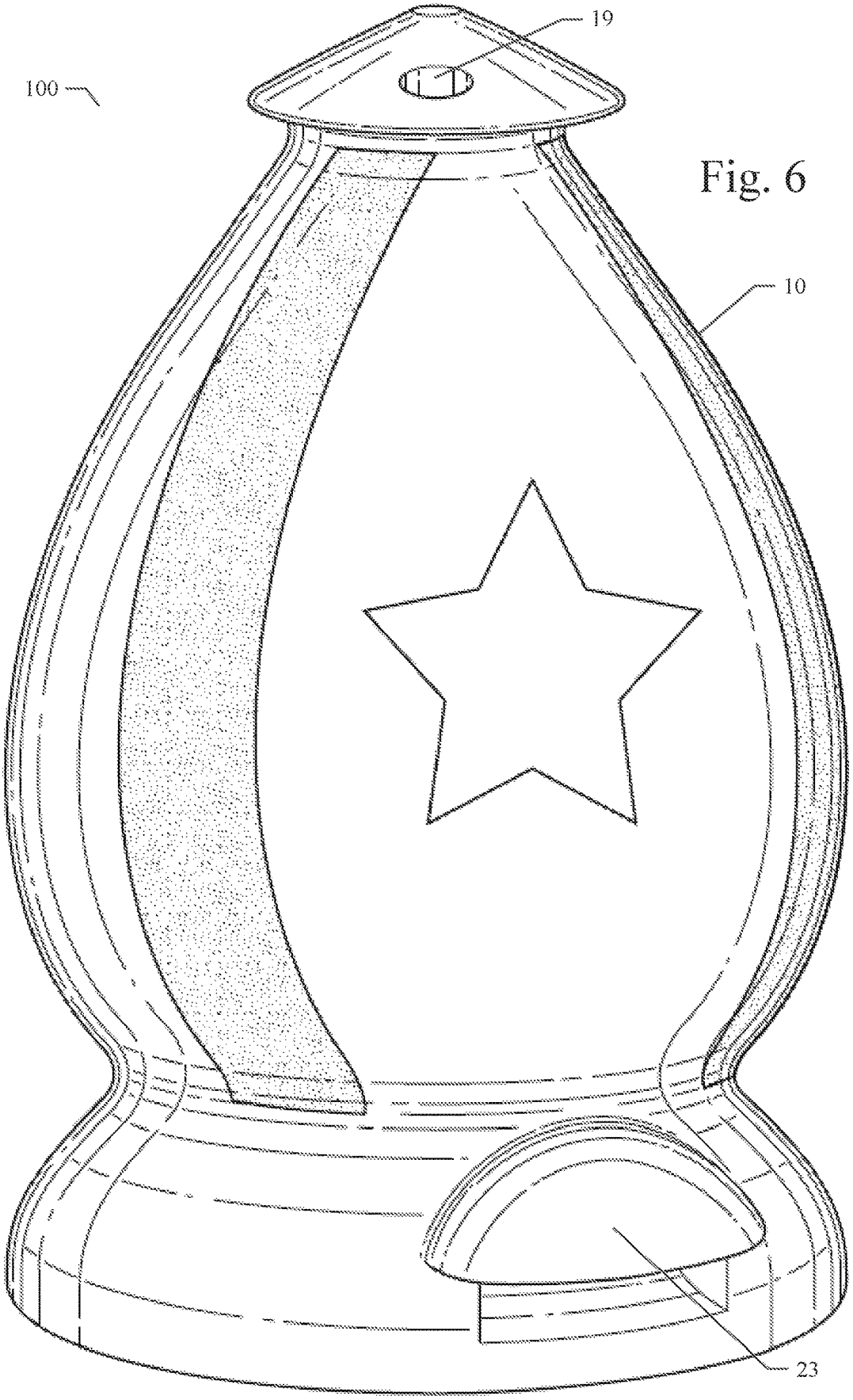
FIG. 6 illustrates a perspective view of the decorative air gap cap cover of an example embodiment.

FIG. 6 illustrates a perspective view of the decorative air gap cap cover 100 of an example embodiment. The hollow decorative shell 10 of the decorative air gap cap cover 100 can be formed to any desired design or shape, while including an upper interior region 11 and lower interior region 12 configured to capture the conventional air gap cap 1 as described above. FIG. 6 also illustrates top vent hole 19 and exit port 23 as described above. In the example embodiment illustrated in FIG. 6, a surface design and shape of the hollow decorative shell 10 is shown with a decorative star and vertical stripes, but other designs and shapes may be used. For example, the exterior of the hollow decorative shell 10 may be decorated with sports team logos, characters from film productions, sponsor advertising, custom photos, political messaging, brands, holiday imagery, or other designs and messaging.

Thus, a decorative air gap cap cover is disclosed.

The illustrations of embodiments described herein are intended to provide a general understanding of the structure of various embodiments, and they are not intended to serve as a complete description of all the elements and features of components and systems that might make use of the structures described herein. Many other embodiments will be apparent to those of ordinary skill in the art upon reviewing the description provided herein. Other embodiments may be utilized and derived, such that structural and logical substitutions and changes may be made without departing from the scope of this disclosure. The figures herein are merely representational and may not be drawn to scale. Certain proportions thereof may be exaggerated, while others may be minimized. Accordingly, the specification and drawings are to be regarded in an illustrative rather than a restrictive sense.

The description herein may include terms, such as "up", "down", "upper", "lower", "first", "second", etc. that are used only for descriptive purposes and not to be construed as limiting. The elements, materials, geometries, dimensions, and sequence of operations may all be varied for particular applications. Parts of some embodiments may be included in, or substituted for, those of other embodiments. While the foregoing examples of dimensions and ranges are considered typical, the various embodiments are not limited to such dimensions or ranges.

The Abstract is provided to allow the reader to quickly ascertain the nature and gist of the technical disclosure. The Abstract is submitted with the understanding that it will not be used to interpret or limit the scope or meaning of the claims. In the foregoing Detailed Description, various features are grouped together in a single embodiment for the purpose of streamlining the disclosure. This method of disclosure is not to be interpreted as reflecting an intention that the claimed embodiments have more features than are expressly recited in each claim. Thus, the following claims are hereby incorporated into the Detailed Description, with each claim standing on its own as a separate embodiment.

As described herein, a decorative air gap cap cover is disclosed. Although the disclosed subject matter has been described with reference to several example embodiments, it may be understood that the words that have been used are words of description and illustration, rather than words of limitation. Changes may be made within the purview of the appended claims, as presently stated and as amended, without departing from the scope and spirit of the disclosed subject matter in all its aspects. Although the disclosed subject matter has been described with reference to particular means, materials, and embodiments, the disclosed subject matter is not intended to be limited to the particulars disclosed; rather, the subject matter extends to all functionally equivalent structures, methods, and uses such as are within the scope of the appended claims.

What is claimed is:

1. A decorative air gap cap cover comprising:

a hollow decorative shell configured with an upper interior region, a lower interior region, a fluid channel, and an internal ridge, the internal ridge configured to rest on an upper surface of a ring gasket installed around an air gap cap, the air gap cap being captured within the upper and lower interior regions of the hollow decorative shell; and a top vent hole providing an air channel between the upper interior region and the exterior of the hollow decorative shell.

2. The decorative air gap cap cover of claim 1 wherein the upper interior region is configured as an open or hollow region above the internal ridge and above the ring gasket.

3. The decorative air gap cap cover of claim 1 wherein the lower interior region is configured as an open or hollow region below the internal ridge and below the ring gasket.

4. The decorative air gap cap cover of claim 1 wherein the fluid channel is configured with an entry opening into the upper interior region above the internal ridge and an exit opening below the internal ridge, the exit opening terminating at an exit port of the hollow decorative shell.

5. The decorative air gap cap cover of claim 1 including an auxiliary fluid channel configured with an entry opening into the lower interior region below the internal ridge and an exit opening below the internal ridge, the exit opening terminating at an exit port of the hollow decorative shell.

6. The decorative air gap cap cover of claim 1 wherein the hollow decorative shell is fabricated from a material of a type from the group consisting of: ceramic, plastic, metal, and wood.

7. The decorative air gap cap cover of claim 1 wherein the ring gasket is fabricated from a material of a type from the group consisting of: rubber, cork, and plastic.

8. The decorative air gap cap cover of claim 1 wherein a bottom gasket is partially or completely integrated into a bottom surface of the hollow decorative shell.

9. The decorative air gap cap cover of claim 1 wherein the exterior of the hollow decorative shell is decorated with a design from the group consisting of: a sports team logo, a character from a film production, sponsor advertising, a custom photo, political messaging, a brand, and holiday imagery.

10. The decorative air gap cap cover of claim 1 wherein the decorative air gap cap cover can completely contain and seal the air gap cap.

11. A decorative air gap cap cover comprising:

a hollow decorative shell configured with an interior region, a fluid channel, and an internal ridge, the internal ridge configured to rest on an upper surface of a ring gasket installed around an air gap cap, the air gap cap being captured within the interior region of the hollow decorative shell; and a top vent hole providing an air channel between the interior region and the exterior of the hollow decorative shell.

12. The decorative air gap cap cover of claim 11 wherein the interior region is configured as an open or hollow region within the decorative air gap cap cover.

13. The decorative air gap cap cover of claim 11 wherein the ring gasket is fabricated from rubber, cork, plastic, or other flexible material.

14. The decorative air gap cap cover of claim 11 wherein the fluid channel is configured with an entry opening into the interior region above the internal ridge and an exit opening below the internal ridge, the exit opening terminating at an exit port of the hollow decorative shell.

15. The decorative air gap cap cover of claim 11 including an auxiliary fluid channel configured with an entry opening into the interior region below the internal ridge and an exit opening below the internal ridge, the exit opening terminating at an exit port of the hollow decorative shell.

16. The decorative air gap cap cover of claim 11 wherein the hollow decorative shell is fabricated from a material of a type from the group consisting of: ceramic, plastic, metal, and wood.

17. The decorative air gap cap cover of claim 11 wherein the ring gasket is fabricated from a material of a type from the group consisting of: rubber, cork, and plastic.

18. The decorative air gap cap cover of claim 11 wherein a bottom gasket is partially or completely integrated into a bottom surface of the hollow decorative shell.

19. The decorative air gap cap cover of claim 11 wherein the exterior of the hollow decorative shell is decorated with a design from the group consisting of: a sports team logo, a character from a film production, sponsor advertising, a custom photo, political messaging, a brand, and holiday imagery.

20. The decorative air gap cap cover of claim 11 wherein the decorative air gap cap cover can completely contain and seal the air gap cap.

* * * * *